US007908701B1

(12) United States Patent
Aiyar

(10) Patent No.: US 7,908,701 B1
(45) Date of Patent: Mar. 22, 2011

(54) ADJUSTABLE CONTOUR-FOLLOWING MOP

(76) Inventor: Sanjay Aiyar, Irvine, CA (US)

( * ) Notice: Subject to any disclaimer, the term of this patent is extended or adjusted under 35 U.S.C. 154(b) by 850 days.

(21) Appl. No.: 11/765,297

(22) Filed: Jun. 19, 2007

Related U.S. Application Data

(63) Continuation-in-part of application No. 11/465,961, filed on Aug. 21, 2006, now Pat. No. 7,328,477, and a continuation-in-part of application No. 11/674,884, filed on Feb. 14, 2007.

(51) Int. Cl.
*A47L 13/12* (2006.01)

(52) U.S. Cl. ..... 15/228; 15/115; 15/118; 15/98; 15/220.1

(58) Field of Classification Search ..... 15/147.2, 15/149, 228, 231, 233, 115, 114
See application file for complete search history.

(56) References Cited

U.S. PATENT DOCUMENTS

| | | | | |
|---|---|---|---|---|
| 908,791 | A | 1/1909 | Mason | |
| 1,069,960 | A | 8/1913 | Kubick | |
| 1,393,532 | A | 10/1921 | Howard, Sr. | |
| 1,665,292 | A * | 4/1928 | Anderson et al. | 15/230.18 |
| 2,682,071 | A * | 6/1954 | Linderoth | 15/147.2 |
| 2,741,790 | A * | 4/1956 | Koehring | 15/147.1 |
| 2,887,712 | A | 8/1957 | Vosbikian et al. | |
| 4,032,239 | A | 6/1977 | Maupin | |
| 5,522,110 | A | 6/1996 | Borofsky | |
| 6,109,811 | A * | 8/2000 | Song | 401/289 |
| 6,253,408 | B1 | 7/2001 | Feld et al. | |
| 6,675,427 | B1 | 1/2004 | Chiapelli et al. | |
| 2006/0070196 | A1 | 4/2006 | Lacotta et al. | |

FOREIGN PATENT DOCUMENTS

JP 10286208 A 10/1998

OTHER PUBLICATIONS

Simoniz Car Wash System (as seen on TV), www.amazon.com/Simoniz-Car-Wash-Syste-Seen/dp/B0006AAVLW.

* cited by examiner

*Primary Examiner* — Monica S Carter
*Assistant Examiner* — Stephanie Newton
(74) *Attorney, Agent, or Firm* — QuickPatents, Inc.; Kevin Prince

(57) ABSTRACT

An adjustable scrubbing implement for cleaning a surface is disclosed. A resilient base that comprises a center portion and a plurality of resilient fingers each is joined at a proximal end thereof to the center portion and extends radially away therefrom. The rigid cap comprises a side portion fixed at a top end thereof to an inside upper side of the cap, and terminates at a wider open lower end. The inside upper side includes a central aperture therethrough. The cap includes a handle receiving means pivotally fixed thereto for receiving a threaded end of an elongated handle. An adjustment means interposed between the cap and the resilient base moves the center portion of the base relative to the inside upper side of the cap. The downward angle of the fingers are defined by the relative distance between the center portion of the base and the inside upper side of the cap. Changing the downward angle of the fingers results in a change in the effective resiliency of the resilient base, which affects the amount of force required to cause the fingers to move into a compressed. As such, the scrubbing characteristics of the scrubbing implement may be selectively adjusted by adjusting the adjustment means.

12 Claims, 4 Drawing Sheets

ADJUSTABLE CONTOUR-FOLLOWING MOP

CROSS-REFERENCE TO RELATED APPLICATIONS

The present invention is a continuation-in-part of U.S. patent application Ser. No. 11/465,961, filed on Aug. 21, 2006; and U.S. patent application Ser. No. 11/674,884, filed on Feb. 14, 2007; which applications are hereby incorporated herein in their entirety.

STATEMENT REGARDING FEDERALLY SPONSORED RESEARCH AND DEVELOPMENT

Not Applicable.

FIELD OF THE INVENTION

This invention relates to mops, and more particularly to an adjustable contour-following mop.

DISCUSSION OF RELATED ART

Mops for cleaning cars are well known in the art. For example, the highly successful Shawala® multi-layer mop of U.S. Pat. No. 5,855,204, to Gray et al. on Jan. 5, 1999, teaches such a device. Such mops are made to conform to contours typical of motor vehicles, as a flat mop is essentially useless on such surfaces. The Gray device relies on the weight of water in a plurality of fingers to cause the fingers to follow contours on the surface. However, such weight is not always sufficient to create a strong enough cleaning force around such contours.

Mop devices that create a stronger cleaning force between cleaning elements and the surface to be cleaned are also known in the art. For example, U.S. Pat. No. 2,727,268 to Hucke on Dec. 20, 1955, discloses a mop having a resilient, deformable washing head. U.S. Pat. No. 2,682,071 teaches a cleaning implement having a deformable suction foot that forces the cleaning implement into firm contact with a surface to be cleaned through an air suction means. While such devices do create a stronger cleaning force for cleaning a contoured surface, such devices are not well suited for concentrated scrubbing of areas of the surface that have caked-on or greasy areas in need of cleaning For example, bird droppings, oil, or other stubborn grime is difficult to remove with such prior art devices.

U.S. Pat. No. 4,032,239 to Maupin on Jun. 28, 1977, also teaches a device having resilient contour-following fingers. The Maupin device, however, additionally includes a means for introducing a jet of water or cleaning fluid to the surface. While such a water jet may help remove stubborn debris to some extent, such a device does not provide for a concentrated water jet sufficient for removing such debris. Further, a flexible mop pad necessarily is interposed between the water jet and the debris, further reducing the effectiveness of such a device. Further, such a device makes no provision for adjusting the effective resiliency of the contour-following fingers, which would allow the user to fine-tune the scrubbing characteristics of the mop based on the surface being washed.

Therefore, there is a need for a contour-following mop that, in addition to providing resilient fingers that can be forced against the surface, further provides an adjustment means to adjust the effective resiliency and contour angle of the fingers. Such a needed device would further provide a secondary mode wherein direct pressure of a secondary cleaning surface may be applied to stubborn debris. Such a necessary secondary cleaning surface would be rubber nibs, brush bristles, or even scraping edges. The needed device would further be relatively inexpensive to manufacture, easy to use and clean, and would be durable under repeated use. When worn over time, the resilient fingers of such a device could be easily replaced. The present invention accomplishes these objectives.

SUMMARY OF THE INVENTION

The present device is a scrubbing implement for cleaning a surface. A resilient base that comprises a center portion and a plurality of resilient fingers each is joined at a proximal end thereof to the center portion and extends radially away therefrom. Each finger includes a distal end opposite the proximal end. A rigid cap comprises a side portion fixed at a top end thereof to an inside upper side of the cap, and terminates at an open lower end. The inside upper side includes a central aperture therethrough. The cap preferably further includes a handle receiving means pivotally fixed thereto for receiving a threaded end of an elongated handle.

An adjustment means interposed between the cap and the resilient base moves the center portion of the base relative to the inside upper side of the cap. The center portion of the base is attached at an attachment means to the adjustment means. The downward angle of the fingers is defined by the relative height between the center portion of the base and the lower edge of the cap. Changing the downward angle of the fingers results in a change in the effective resiliency of the resilient base, which affects the amount of force required to cause the fingers to move into a compressed state as well as the severity of the cone shape of the mop overall. As such, the scrubbing characteristics of the scrubbing implement may be selectively adjusted by adjusting the adjustment means.

In one embodiment of the invention, the adjustment means includes a threaded shaft fixed at one end to the center portion of the resilient base and terminating at a second end at a shaft adjustment actuator. The upper end of the cap further includes a threaded portion for cooperating with the threaded shaft of the adjustment means. As such, the distance between the center portion of the base and the upper end of the cap may be manually selected by turning the shaft, resulting in a change in the downward angle of the fingers.

A flexible pad is included that comprises a cleaning surface on a lower side thereof. The pad has an elastic ring around its periphery, forming an aperture in the pad for receiving the distal ends of each finger of the base. The pad is mounted to the base by inserting the distal ends of the fingers into the peripheral lip and held in place securely by the elastic ring. It is additionally attached to the base near the center with an attachment means, such as hook-and-loop type material. The central attachment means ensures a close contact of the pad with the base. The flexible pad is fixed around the distal ends of the fingers such that the pad may be applied to the surface to scrub the surface, the fingers and flexible pad conforming generally to the shape of the surface.

The present invention is a contour-following mop that also, in addition to providing resilient fingers that can be forced against the surface, further provides an adjustment means to adjust the effective contour angle and resiliency of the fingers. The present device further provides a secondary mode wherein direct pressure of a secondary cleaning surface may be selectively applied to stubborn debris. Such a necessary secondary cleaning surface may be rubber nibs, brush bristles, or even scraping edges. The present invention further is relatively inexpensive to manufacture, easy to use and clean, and would be durable under repeated use. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Figure 1:
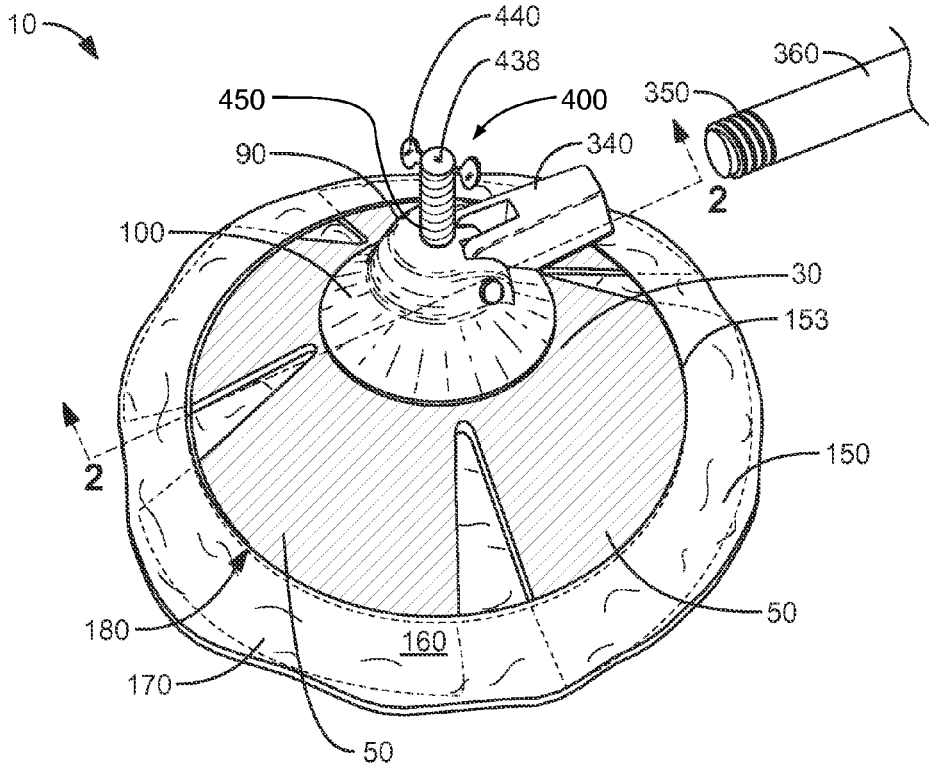
FIG. 1 is a perspective view of the invention, illustrating a scrubbing implement detached from an elongated handle of the invention.
Figure 3:
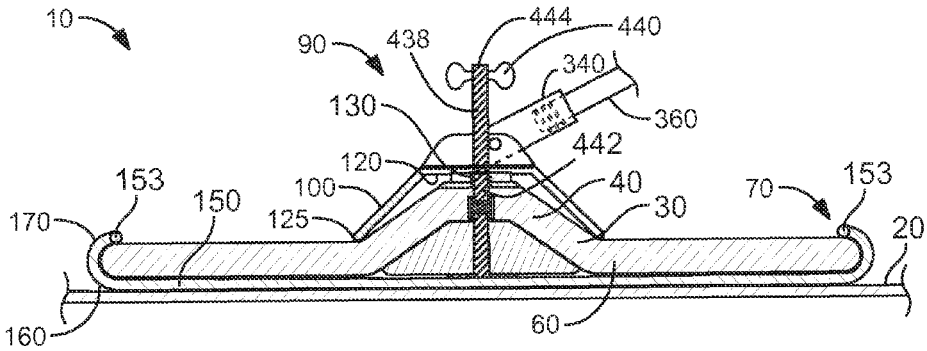
FIG. 3 is a cross-sectional view of the invention, taken generally along lines 2-2 of FIG. 1, and illustrating the resilient base with the radially-extending fingers in a compressed configuration, the scrubbing implement and the resilient base engaged with a surface to be cleaned, and further illustrating an embodiment wherein the adjustment means includes a threaded shaft.

The present invention is a scrubbing implement 10 for cleaning a surface 20. As illustrated in FIGS. 1 and 3, a resilient base 30 that comprises a center portion 40 and a plurality of resilient fingers 50 each is joined at a proximal end 60 thereof to the center portion 40 and extends radially away therefrom. Each finger 50 includes a distal end 70 opposite the proximal end 60. The rigid cap 90 comprises a side portion 100, preferably frusto-conical in shape, fixed at a top end 110 thereof to an inside upper side 120 of the cap 90, and terminates at an open lower end 125. The inside upper side 120 includes a central aperture 130 therethrough. The resilient base 30 is preferably made from a resilient foam material such as EVA, or the like, and the cap 90 is preferably made from a rigid plastic material, but can also be formed from wood or metal, if desired.

An adjustment means 400 interposed between the cap 90 and the resilient base 30 moves the center portion 40 of the base 30 relative to the inside upper side 120 of the cap 90. The center portion 40 of the base 30 is attached at an attachment means 140 to the adjustment means 400. The downward angle of the fingers 50 is defined by the relative distance between the center portion 40 of the base 30 and the open lower end 125 of the cap 90. Changing the downward angle of the fingers 50 results in a change in the effective resiliency of the resilient base 30, which affects the amount of force required to cause the fingers 50 to move into the compressed position shown in FIGS. 3 and 4. As such, the scrubbing as well as the contour-forming characteristics of the scrubbing implement 10 may be selectively adjusted by adjusting the adjustment means 400.

Figure 4:
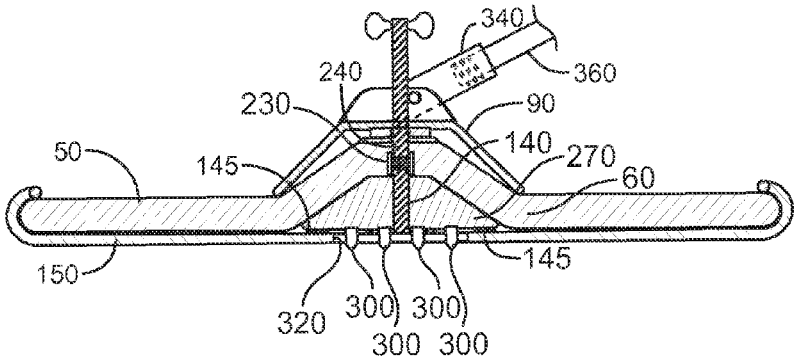
FIG. 4 is a cross-sectional view of the invention, taken generally along lines 2-2 of FIG. 1, and illustrating the secondary resilient base with the plurality of scrubbing nibs, the nibs for making contact with the surface to be cleaned.
Figure 5A:
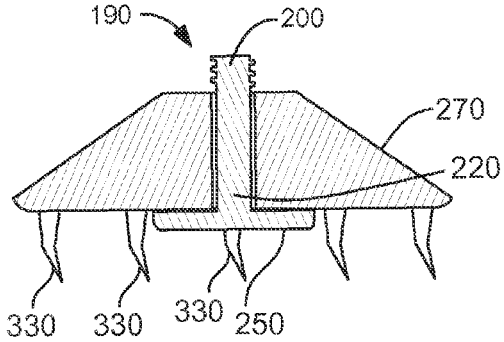
FIG. 5A is a cross-sectional view of an alternate embodiment of the secondary resilient base, illustrating a plurality of scraping edges attached thereto and to the head of a bolt that attaches the secondary resilient base to the resilient base.
Figure 5B:
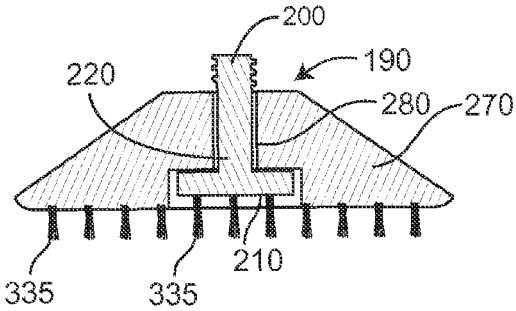
FIG. 5B is a cross-sectional view of an alternate embodiment of the secondary resilient base, illustrating a plurality of brush bristles attached thereto and to the head of the bolt.

In one embodiment of the invention, illustrated in FIGS. 3 and 4, a bolt 190 is included for attaching a secondary base 270 to the resilient base 30. The bolt 190 has a threaded shaft 200 and a head 210 at one end 220 of the shaft 200 (FIG. 5B). The head 210 is larger in diameter than an aperture 280 of the secondary base 270. The head 210 of the bolt 190 has a lower side 250 for attaching to the back side 260 of the flexible pad 150 proximate the center of the flexible pad 150 with an attachment means 145, such as a hook and loop type fastening material, a mechanical snap (not shown), magnets (not shown), or the like. Further, the attachment means 145 has a receiving thread 230 in a top portion 240 of the aperture 130 thereof. The receiving thread 230 rotatably receives the threaded shaft 200 of the bolt 190. Clearly, however, other means of attaching the secondary base 270 to the resilient base 30 could be devised by those skilled in the art, such as adhesive, alternate mechanical means, or the like (not shown). Further, the secondary base 270 may be removed, if desired, when the resilient base 30 is adjusted to assume a completely flat orientation (not shown).

Figure 2A:
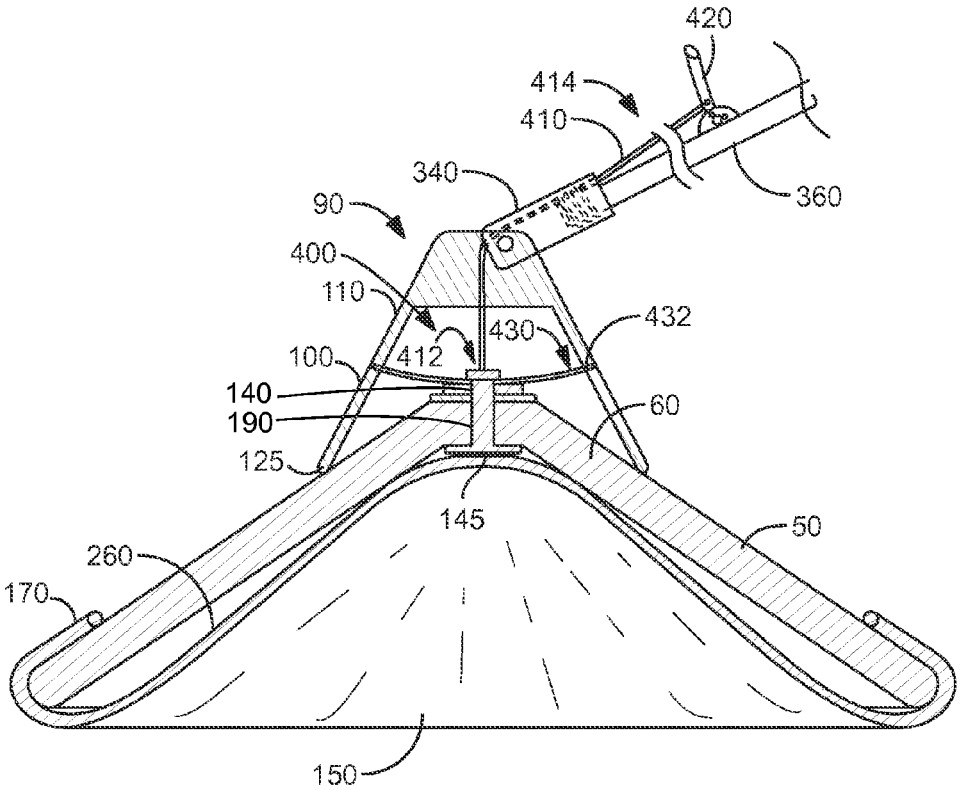
FIG. 2A is a cross-sectional view of the invention, taken generally along lines 2-2 of FIG. 1, and illustrating a resilient base with radially-extending fingers in an uncompressed configuration in an embodiment of the invention having a flat spring in an adjustment means interposed between a resilient base and a rigid cap of the invention.

In one embodiment of the invention, the adjustment means 400 includes a cable 410 fixed at one end 412 to the center portion 40 of the resilient base 30 and terminating at a second end 414 at an adjustment actuator 420 (FIG. 2A). In such an embodiment, the cap 90 preferably further includes a handle receiving means 340 pivotally fixed thereto for receiving a threaded end 350 of an elongated handle 360. The handle 360 provides a means for direct hand application of the scrubbing implement 10 to the surface 20, such as in the case of a conventional mop. The adjustment actuator 420 preferably is fixed to the handle 360 at a position where the user of the scrubbing implement 10 does not have to bend over to actuate same (FIG. 2A). The cap 90 may also be adapted for receiving a snap-in end of an elongated handle (not shown), or any other type of commonly-used handle 360.

The adjustment means 400 may further include a spring means 430 for biasing the center portion 40 of the resilient base 30 away from the inside upper side 120 of the cap 90. Preferably the spring means 430 is a flat spring 432 connected across the open lower end 125 of the cap 90 and to the center portion 40 of the resilient base 30. Alternately, however, the spring means 430 may be a coil spring 434 fixed at one end 435 to the inside upper side 120 of the cap 90 and at a second end 436 to the center portion 40 of the resilient base 30. In such an embodiment, illustrated in FIG. 2B, the coil spring 434 urges the resilient base 30 away from the inside upper side 120 of the cap 90. The adjustment actuator 420 may be selectively set at a desired position to overcome the spring force of the spring means 430.

In another embodiment of the invention, illustrated in FIGS. 1 and 3, the adjustment means 400 includes a threaded shaft 438 fixed at one end 442 to the center portion 40 of the resilient base 30 and terminating at a second end 444 at a shaft adjustment actuator 440. The upper end 120 of the cap 90 further includes a threaded portion 450 for cooperating with the threaded shaft 438 of the adjustment means 400. As such, the distance between the center portion 40 and the upper end 120 of the cap 90 may be manually selected by turning the shaft 438, resulting in a change in the downward angle of the fingers 50.

Figure 2B:
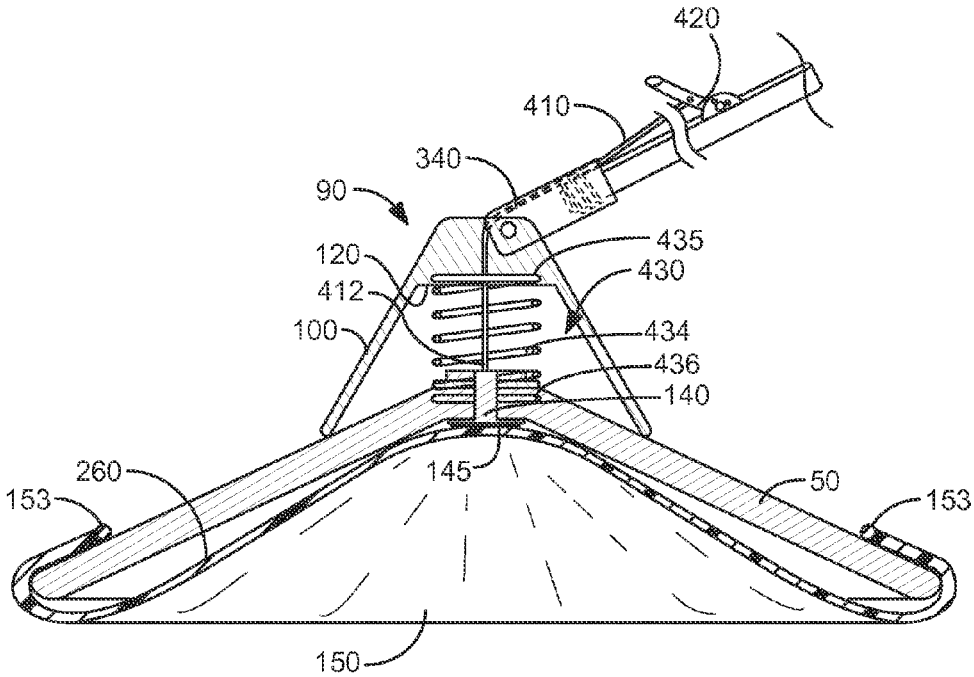
FIG. 2B is a cross-sectional view of the invention, taken generally along lines 2-2 of FIG. 1, and illustrating an embodiment of the invention having a coil spring in the adjustment means.

A flexible pad 150 is included that comprises a cleaning surface 160 on a lower side thereof. The pad 150 has an elastic ring 153 around its periphery, forming an aperture 180 in the pad 150 for receiving the distal ends 70 of each finger 50 of the base 30. The pad 150 is mounted to the base 30 by inserting the distal ends of the fingers 50 into the peripheral lip 170 and held in place securely by the elastic ring 153. It is additionally attached to the base 30 with an attachment means 145, such as hook-and-loop type material (FIGS. 2A and 2B). The attachment means 145 ensures a close contact of the pad 150 with the base 30. The flexible pad 150 is fixed around the distal ends 70 of the fingers 50 such that the pad 150 may be applied to the surface 20 to scrub the surface 20. The fingers 50 and flexible pad 150 conform generally to the shape of the surface 20.

The flexible pad 150 may be a sheet of fabric, such as terrycloth, a section of fabric with a plurality of folds (not shown), a sheet of sponge material (not shown), or the like.

In one embodiment of the invention, the secondary resilient base 270 is detachably affixed below the center portion 40 of the resilient base 30 (FIGS. 3, 4, 5A and 5B). The secondary base 270 may include at least one scrubbing nib 300 for contacting the back side of the pad 150 (FIG. 4). As such, additional and alternate types of scrubbing force may be applied to the surface 20 when desired simply by pressing the scrubbing implement 10 firmly into the surface 20 to cause the scrubbing nibs 300 to contact the surface 20. In such an embodiment, the flexible pad 150 may include a second smaller aperture 320 in the approximate center of the pad 150. As such, the secondary base 270 may contact the surface 20 directly when the fingers 50 of the base 30 are in a compressed orientation (FIG. 4). The secondary base 270 may further include a brush 335, a scraper 330, or other similar scrubbing or cleaning implements. In such an embodiment the attachment means 145 takes the shape of a ring (FIG. 4) surrounding the opening 320.

In use, the base 30 and the pad 150 generally extend down and out from the inside upper side 120 of the cap 90 and provide a resilient scrubbing surface 160 for application to the surface 20. The fingers 50 and the pad 150 conform to the shape of the surface 20, and the downward angle of the fingers 50 are selectively adjusted by actuation of the adjustment means 400.

Figure 6:
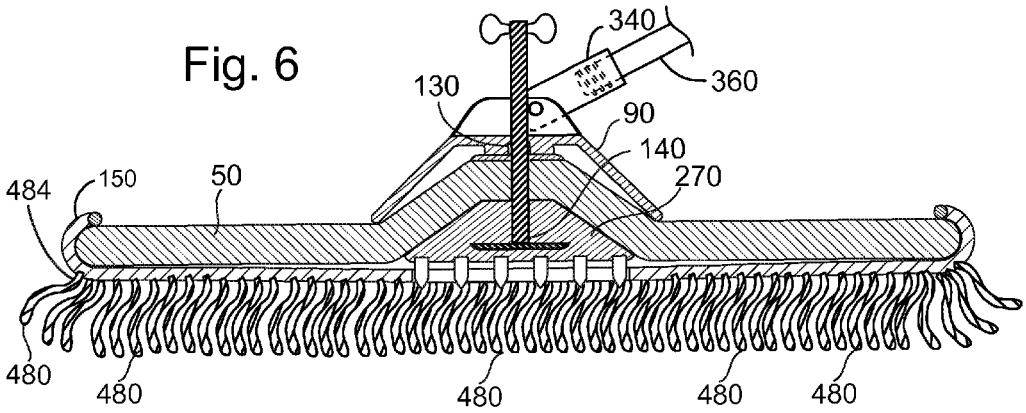
FIG. 6 is a cross-sectional view of an alternate embodiment of the invention, illustrating a flexible pad having a plurality of absorbent mop strands each fixed at one end thereof to the cleaning surface of the pad.
Figure 7:
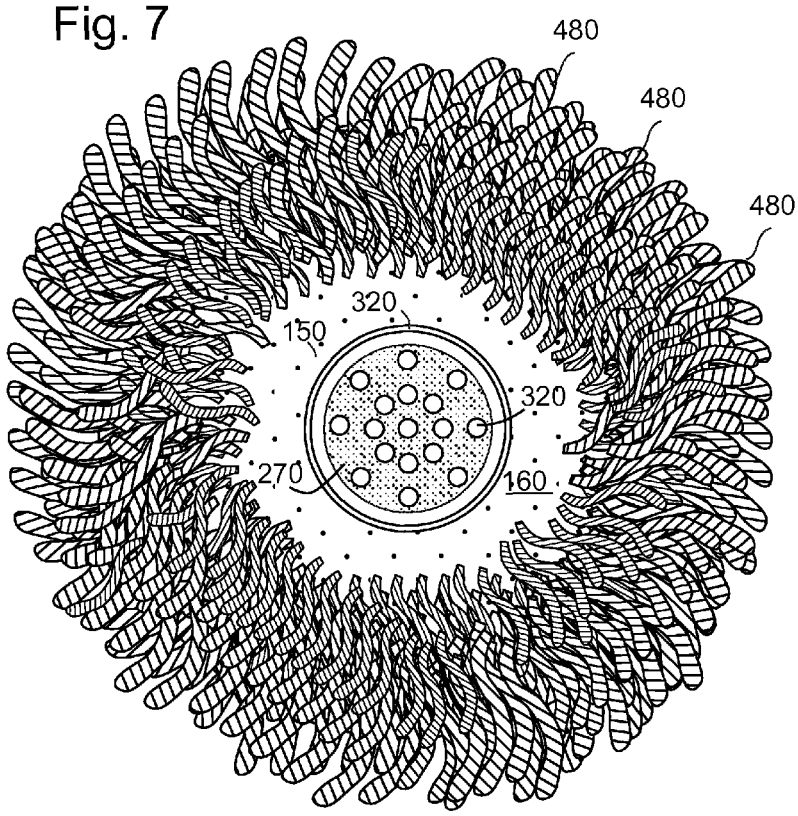
FIG. 7 is a bottom plan view of the embodiment of the invention illustrated in FIG. 6.

In another alternate embodiment of the invention, illustrated in FIGS. 6 and 7, the flexible pad 150 further includes a plurality of absorbent mop strands 480 each fixed at one end 484 thereof to the cleaning surface 160.

While a particular form of the invention has been illustrated and described, it will be apparent that various modifications can be made without departing from the spirit and scope of the invention. For example, the round shape of the resilient base 30 and the pad 150 may be modified to be oval, square, rectangular, or any other suitable shape (not shown). Likewise, the exact number of fingers 50 may be modified from that illustrated in the drawings. Likewise, the spring means 430 may be implemented by various means known in the art. Further, the secondary base 270 may include various types of scrubbing implements, such as the brush 335, sandpaper, and the like. Accordingly, it is not intended that the invention be limited, except as by the appended claims.

What is claimed is:

1. A scrubbing implement for cleaning a surface comprising:

a rigid cap, the cap comprising an inside upper side and an open lower end;

a resilient base attached to the inside upper side of the cap, the base comprising a plurality of fingers extending radially outwards and downward from the lower end the cap;

an adjustment means interposed between the cap and the resilient base for moving a center portion of the base relative to the inside upper side of the cap, the downward angle of the fingers defined by the relative distance between the center portion of the base and the lower open end of the cap;

a flexible pad located under and mounted to the base, the lower side of the pad forming a cleaning surface;

wherein the base and the pad generally conform to and extend down and out from the inside of the cap and provide a resilient scrubbing surface for application to the surface, the fingers and the pad conforming to the shape of the surface, the downward angle of the fingers being selectively adjustable by actuation of the adjustment means.

2. The scrubbing implement of claim 1 wherein a secondary resilient base is detachably affixed below and to a center point of the pad, the secondary base making contact with the surface when the fingers of the base are in a compressed orientation.

3. The scrubbing implement of claim 2 wherein the secondary base comprises a brush.

4. The scrubbing implement of claim 1 further including a handle fixed to the cap, the handle providing a means for direct hand application of the scrubbing implement to the surface.

5. The scrubbing implement of claim 1 wherein the adjustment means includes a cable fixed at one end to the center portion of the resilient base and terminating at a second end at an adjustment actuator, the adjustment means further including a spring means for biasing the center portion of the resilient base away from the inside upper side of the cap.

6. The scrubbing implement of claim 5 wherein the spring means is a coil spring fixed at one end to the inside upper side of the cap and at a second end to the center portion of the resilient base, the coil spring urging the resilient base away from the inside upper side of the cap.

7. The scrubbing implement of claim 1 wherein the adjustment means includes a threaded shaft fixed at one end to the center portion of the resilient base and terminating at a second end at a shaft adjustment actuator, the upper end of the cap further including a threaded portion for cooperating with the threaded shaft of the adjustment means.

8. A scrubbing implement for cleaning a surface, the scrubbing implement comprising:

a resilient base comprising a center portion and a plurality of resilient fingers each joined at a proximal end to the center portion and extending radially away therefrom, each finger including a distal end opposite the proximal end thereof, the center portion further including a center portion attachment means;

a rigid cap comprising a side portion fixed at a top end thereof to a upper end of the cap, the upper end including a central aperture therethrough;

an adjustment means fixed to the attachment means of the center portion for moving the center portion relative to the upper end of the cap, the downward angle of the fingers defined by the side portion of the cap and the relative distance between the center portion of the base and the open lower end of the cap;

a flexible pad includes a cleaning surface on a lower side thereof, the pad further including a peripheral lip forming an aperture in the pad for receiving the distal ends of each finger of the base;

whereby with the base fixed to the cap with the adjustment means and with the flexible pad fixed around the distal ends of each of the fingers, the pad may be applied to the surface to scrub the surface, the fingers and pad conforming to the shape of the surface, the downward angle of the fingers being selectively adjustable by actuation of the adjustment means.

9. The scrubbing implement of claim 8 wherein the adjustment means includes a cable fixed at one end to the center portion of the resilient base and terminating at a second end at an adjustment actuator, the adjustment means further including a spring means for biasing the center portion of the resilient base away from the inside upper side of the cap.

10. The scrubbing implement of claim 9 wherein the spring means is a coil spring fixed at one end to the inside upper side of the cap and at a second end to the center portion of the resilient base, the coil spring urging the resilient base away from the inside upper side of the cap.

11. The scrubbing implement of claim 8 wherein the adjustment means includes a threaded shaft fixed at one end to the center portion of the resilient base and terminating at a second end at a shaft adjustment actuator, the upper end of the cap further including a threaded portion for cooperating with the threaded shaft of the adjustment means.

12. The scrubbing implement of claim 8 further including a handle fixed to the cap, the handle providing a means for direct hand application of the scrubbing implement to the surface.

* * * * *